United States Patent [19]

Quang

[11] Patent Number: 4,607,940

[45] Date of Patent: Aug. 26, 1986

[54] REVERSED DEVELOPMENT ELECTROPHOTOGRAPHIC PRODUCTION PROCESS AND APPARATUS

[75] Inventor: Pham K. Quang, Dieppe, France

[73] Assignee: Rhone-Poulenc Systemes, Nanterre, France

[21] Appl. No.: 683,169

[22] Filed: Dec. 18, 1984

[30] Foreign Application Priority Data

Dec. 22, 1983 [FR] France ..... 83 20799

[51] Int. Cl.[4] ..... G03G 15/00

[52] U.S. Cl. ..... 355/3 R; 355/3 DD; 355/3 TE; 355/10

[58] Field of Search ..... 355/3 R, 10, 3 TE, 3 DD, 355/14 D

[56] References Cited

U.S. PATENT DOCUMENTS

| | | | |
|---|---|---|---|
| 3,666,458 | 5/1972 | Arneth et al. | 355/3 TE X |
| 3,817,615 | 6/1974 | Adachi et al. | 355/3 TE |
| 4,056,314 | 11/1977 | Silverberg | 355/10 |
| 4,068,588 | 1/1978 | Nakano et al. | 355/3 R X |
| 4,357,096 | 11/1982 | Fetterman | 355/3 R X |
| 4,415,254 | 11/1983 | Nishikawa | 355/3 TR |
| 4,521,502 | 6/1985 | Sakai et al. | 355/3 R X |

*Primary Examiner*—A. C. Prescott

*Attorney, Agent, or Firm*—Sherman & Shalloway

[57] ABSTRACT

A reversed development electrophotographic reproduction process for developing a charge image on a photoconducting support using a single component magnetic developer provides copies with improved densities of the dark regions, better definition and less contamination of the background. This is accomplished by connecting each of the photoconductor surface, the magnetic means for transferring the magnetic development powder from a supply source to the charge image to thereby form the powder image, and the conducting support to which the powder image is transferred to at least one voltage generator via the terminal having the same polarity as that of the charge on the photoconductor surface. Thus, for a positively charged selenium alloy photoconducting surface, the photoconductor, magnetic means, and conducting support are each connected to the positive terminal of preferably a single voltage generator. Apparatus for carrying out the process is also provided.

15 Claims, 1 Drawing Figure

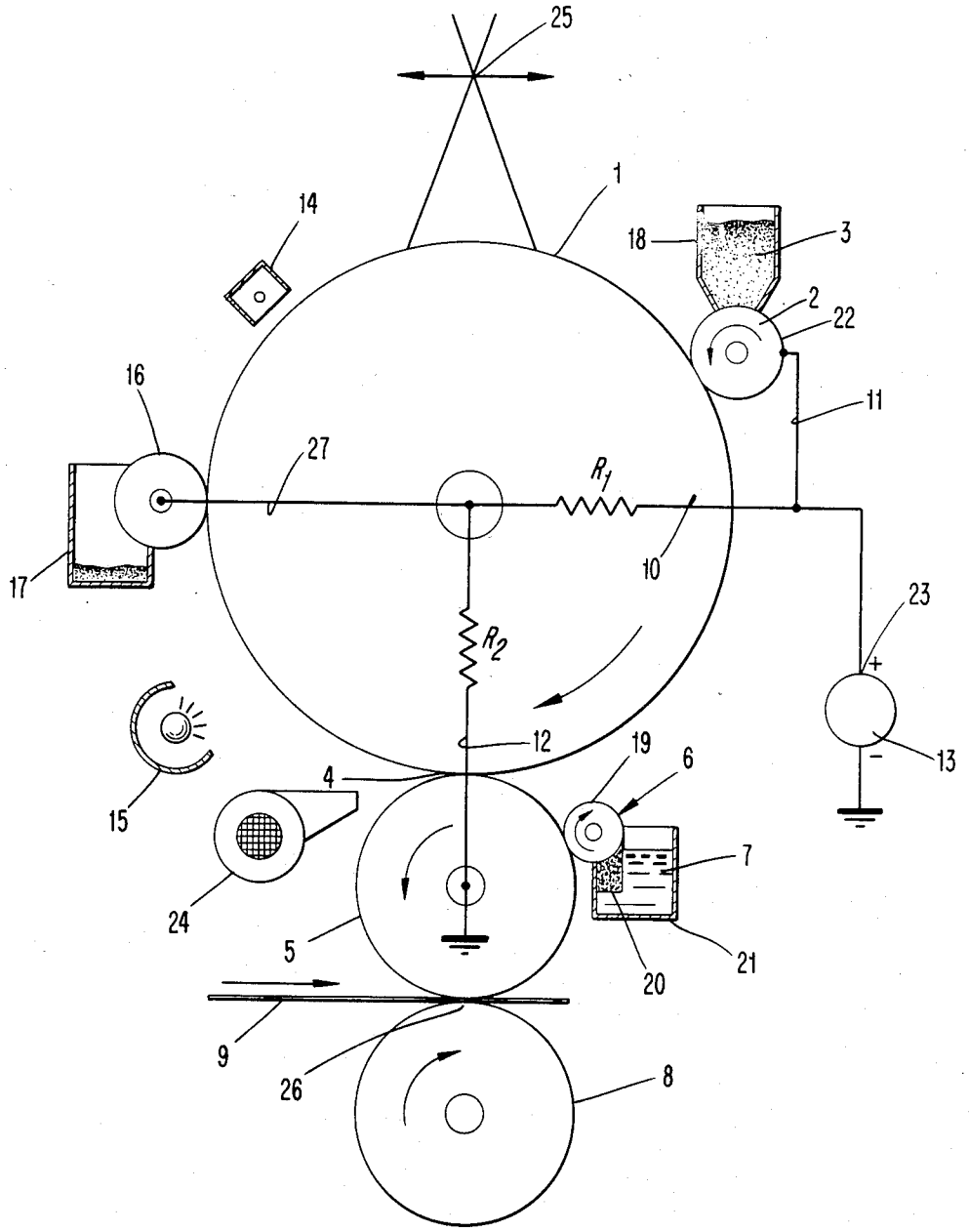
25
1
14
18
3
2
22
16
11
27
$R_1$
17
10
23
$R_2$
+
12
19
6
13
4
15
7
24
5
21
20
9
26
8

REVERSED DEVELOPMENT ELECTROPHOTOGRAPHIC PRODUCTION PROCESS AND APPARATUS

The present invention relates to an electrophotographic reproduction process with reversed development on a conducting support using a single-component magnetic development powder and to a device for carrying out the electrophotographic reproduction process.

A process and a device for electrophotographic reproduction on a conducting support using a single-component magnetic development powder are described in the French Patent Application registered under No. 80/10,611, published under No. 2,482,323.

According to this process:

a charge image is produced on a photoconducting surface, a single-component magnetic development powder is directed into proximity with the photoconducting surface by magnetic means, the charge image is developed to form a powder image, the powder image is transferred onto a conducting support which has previously been coated with a layer of volatile dielectric liquid of volume resistivity greater than $10^3\ \Omega\ cm^2/cm$, the liquid remaining present on the conducting support for at least the time needed for transferring the powder image onto the conducting support, the powder image is optionally transferred from the conducting support onto a copy support, the transferred powder image is fixed.

The device for carrying out this process incorporates:

a photoconducting surface, magnetic means for directing a single-component magnetic development powder into proximity with the photoconducting surface and developing a charge image formed on the photoconducting surface, to obtain a powder image, means for transferring the powder image onto a conducting support, means for coating the conducting support with a volatile dielectric liquid of volume resistivity greater than $10^3\ \Omega\ cm^2/cm$ prior to the transfer of the powder image, optionally, means for transferring the powder image from the conducting support onto a copy support, means for fixing the powder image.

Although this process and the device for carrying it out generally give satisfactory results for the electrophotographic reproduction with reversed development, the image obtained is not always of very high quality. In fact, it sometimes leads to density differences especially in the dark regions, where lighter regions appear. In addition, the image obtained often lacks definition and is formed on a background contaminated by the development powder.

The present invention has as its subject an improvement of the process and of the device according to the French Patent Application registered under No. 80/10,611, published under No. 2,482,323.

An object of the invention is an electrophotographic reproduction process, with reversed development, and a device for carrying it out, on a conducting support using a single-component magnetic development powder, which enables an image of very high quality to be obtained which does not, in particular, show lighter regions in the dark regions, which is well defined and which is formed on a clean background.

An improved electrophotographic reproduction process with reversed development is provided, in which:

a charge image is produced on a photoconducting surface, a single-component magnetic development powder is directed into proximity with the photoconducting surface by magnetic means, the charge image is developed in a reversed manner to form a powder image, the powder image is transferred onto a conducting support in the presence of a layer of volatile dielectric liquid of volume resistivity greater than $10^3\ \Omega\ cm^2/cm$, the liquid remaining present on the conducting support for at least the time needed for transferring the powder image onto the conducting support, the powder image is optionally transferred from the conducting support onto a copy support, the transferred powder image is fixed, characterised in that the photoconducting surface, the magnetic means and the conducting support are connected to the terminal of at least one voltage generator, the terminal having the same sign as that of the charge on the photoconducting surface.

In the present text, by convention, it is stated that the conducting support is connected to the terminal of at least one voltage generator, the terminal having the same sign as that of the charge of the photoconducting surface. It could equally well have been stated, choosing another convention, considering that the conducting support and the voltage generator are both grounded, that the conducting support is connected to the terminal of at least one voltage generator, the terminal having the opposite sign to that of the charge on the photoconducting surface.

Advantageously, according to the electrophotographic reproduction process which is the subject of the invention, the photoconducting surface, magnetic means and conducting support are connected to the terminal of one and the same voltage generator, the terminal having the same sign as that of the charge on the photoconducting surface.

Preferably, the electrophotographic reproduction process according to the invention is such that the voltage applied to the magnetic means is at least equal to the voltage applied to the photoconducting surface.

Advantageously, the voltage applied to the magnetic means is higher than the voltage applied to the photoconducting surface.

There has also been discovered a device for electrophotographic reproduction with reversed development which is designed for carrying out the reproduction process according to the invention.

Such a device incorporates, in particular:

a photoconducting surface, magnetic means for directing a single-component magnetic development powder into proximity with the photoconducting surface and developing in a reversed manner a charge image formed on the photoconducting surface, to obtain a powder image, means for transferring the powder image onto a conducting support, means for wetting the conducting support with a volatile dielectric liquid of volume resistivity greater than $10^3\ \Omega\ cm^2/cm$ prior to transferring the powder image, optionally, means for transferring the powder image from the conducting support onto a copy support, means for fixing the powder image, characterised in that it incorporates means for connecting the photoconducting surface, magnetic means and conducting support to the terminal of at least one voltage generator, the terminal having the same sign as that of the charge on the photoconducting surface.

As above, in the present text, by convention, the conducting support is connected to the terminal of at least one voltage generator, the terminal having the same sign as that of the charge on the photoconducting surface, by means which consist of conducting wires and resistor elements. Choosing another convention, the grounded conductor support is connected to the terminal of at least one voltage generator, the terminal having the opposite sign to that of the charge on the photoconducting surface.

Any of the photoconducting surfaces generally used in electrophotographic reproduction can be used in this invention. Thus, the photoconducting surface can be produced from selenium, an alloy containing selenium, cadmium sulphide or zinc oxide, or can be produced from an organic photoconducting material such as polyvinylcarbazole or an oxidiazole derivative.

A selenium or selenium alloy photoconducting surface is positively charged while a cadmium sulphide or zinc oxide photoconducting surface is negatively charged, and the majority of organic photoconducting materials are also negatively charged.

In the present text, the term "photoconducting surface" implies no assumptions regarding the geometrical form of the latter. The photoconducting surface can, for example, take the form of a flexible band, which may or may not be endless, or most often take the form of a cylindrical surface which is generally of circular cross-section.

In the present text, the "magnetic means" refers to the means which carries the single-component magnetic development powder into proximity with the photoconducting surface and which causes the development of the charge image with the development powder into a powder image.

Thus, the magnetic means are such that part of their external surface is in contact with the magnetic development powder present in a container, in order to draw it up, and that their external surface, once laden with magnetic development powder, comes into proximity with the photoconducting surface bearing the charge image, so that the magnetic development powder is transferred to the photoconducting surface to form the powder image.

As magnetic means, there may be used, for example, a magnetic brush or band, for example made of magnetic rubber or from a fabric or film tape coated with a magnetic coating, such a band also being conducting.

Preferably, a magnetic brush is used composed of a metallic cylinder, referred to as a sleeve, in which magnets are rotated, and the magnetic brush thus holds the single-component magnetic development powder on the surface of the sleeve.

Within the scope of the present invention, there is understood by single-component magnetic development powder a development powder in which there is only one single type of magnetic particle present, and these are coated with a suitable resin and possess a volume resistivity less than, or at most equal to, $10^{15}$ $\Omega$ $cm^2/cm$, and also mixtures of development powders, as defined above, having different resistivities and particle sizes.

Thus, the magnetic development powder can consist of metal oxide particles, for example iron oxide particles, coated with resin which can incorporate special adjuvants in order to improve the fluidity of the magnetic development powder or the fixing properties, or to modify the charge picked up by the particles.

The means for transferring the powder image onto the conducting support are of a well-known type. They can employ the action of an electric field or the corona effect, or can combine the action of an electric field and the pressure between the photoconducting surface and the conducting support.

The parameters which determine the choice of the means of transfer are well known and within the field of the specialist.

In the present text, "conducting support" denotes a support, the surface resistivity of which is less than $10^{13}$ $\Omega$ $cm^2/cm$. The "conducting support" can be a conductor in the bulk, and it can also be a conductor only in the vicinity of the surface onto which the powder image is transferred, so that it is not a departure from the scope of the invention to employ a conducting support which is formed from a conducting support as defined above associated with a base which is, for example, non-conducting.

The conducting supports which can be employed in the present invention can be of any kind. Thus, low resistivity supports such as metal supports are very suitable. It is thus possible, according to the type of conducting support used, to produce, for example, lithographic printing plates directly by using an ink-binding magnetic development powder and a conducting support made of treated polyester, metal, coated paper or the like, or to produce projectable "transparencies" directly by using a transparent polyester film coated with a conducting layer as the conducting support.

In the present text, the term "conducting support" implies no assumptions regarding the geometrical form of the latter. The conducting support can, for example, take the form of a flexible band which may or may not be endless, of a rigid, semi-rigid or flexible plate, or of foil, or can take the form of a cylindrical surface which is generally of circular cross-section.

The means for wetting the conducting support are of a type commonly used, and means for coating can be used in particular. With a mobile conducting support, fixed means for coating can be used such as, for example, a brush or pad. The means for coating preferably consist of a device having a rotating coating roller.

As a volatile dielectric liquid of volume resistivity greater than $10^3$ $\Omega$ $cm^2/cm$, those liquids are used which are not too volatile so that a thin layer of liquid is effectively present at all points of the conducting support at the time of transferring the powder image, but are also sufficiently volatile to evaporate rapidly. Thus, a liquid is preferably used which has a volatility index between 0.01 and 0.4 according to the NFT standard 30-301 of August 1969.

The dielectric liquid used will preferably not be a solvent for the material forming the photoconducting surface, in order not to damage the latter. The dielectric liquid will preferably also not be a solvent for the resins used for producing the magnetic development powder, in order not to induce even a partial softening of the magnetic development powder, which would thereby run the risk of becoming fixed onto the conducting support in a deleterious manner.

For further precise details regarding the nature and properties of the dielectric liquid, reference can be made to the French Patent Application registered under No. 80/10,611, published under No. 2,482,323.

As means for the optional transfer of the powder image from the conducting support onto a copy support, customary means can be used, for example, the powder image can be transferred from the conducting support onto a copy support by means of pressure.

As a means for fixing the powder image onto the conducting support or copy support, pressure fixation means can be used, the conducting support or copy support passing between two pressure rollers. Means for transferring the powder image by pressure can naturally constitute means for fixing the powder image. Fixing means consisting of heating means can also be used, such as an infra-red strip or oven, and such fixing means can naturally be combined with means for fixing by pressure.

It is of course possible to combine fixation by pressure and fixation by heating, by using heated pressure rollers as a means for fixing the powder image.

According to the invention, as mentioned above, the device incorporates means for connecting the photoconducting surface, magnetic means and conducting support to the terminal of at least one voltage generator, the terminal having the same sign as that of the charge on the photoconducting surface.

As a voltage generator, the type customarily used in electrophotographic reproduction can be used in this invention.

Thus, with a photoconducting surface which is positively charged, such as a selenium or selenium alloy photoconducting surface, the photoconducting surface, magnetic means and conducting support are connected to the positive terminal of at least one voltage generator.

With a photoconducting surface which is negatively charged, such as a photoconducting surface made of cadmium sulphide or zinc oxide or in organic photoconducting material, the photoconducting surface, the magnetic means and the conducting support are connected to the negative terminal of at least one voltage generator.

Although several voltage generators can be used, the device according to the invention is such that it preferably incorporates means for connecting the photoconducting surface, the magnetic means and the conducting support to the terminal of one and the same voltage generator, the terminal having the same sign as that on the charge on the photoconducting surface.

A device incorporating a single voltage generator enables powder images of excellent quality to be obtained.

Advantageously, the device according to the invention incorporates means for applying a voltage to the magnetic means which is at least equal to the voltage applied to the photoconducting surface. Preferably, it incorporates means for applying a voltage to the magnetic means which is higher than the voltage applied to the photoconducting surface.

A device for electrophotographic reproduction with reversed development, according to the invention, the magnetic means of which consist of a magnetic brush, is preferably such that the sleeve of the magnetic brush is connected to the voltage generator.

The invention will be better understood by the description of the attached FIGURE, which illustrates schematically and without a prescribed scale one embodiment of the device for electrophotographic reproduction, with reversed development, on a conducting support by means of a single-component magnetic development powder, which is the subject of the invention.

In the present text, for ccnvenience, the embodiment of the device for electrophotographic reproduction, with reversed development, which is the subject of the invention and is described below and shown in the attached FIGURE, is such that the photoconducting surface is a cylindrical surface cf circular cross-section, that the magnetic means are a magnetic brush, and the conducting support takes the form of a cylindrical surface, the photoconducting surface, magnetic brush and conducting support being located such that their axes are parallel.

The attached FIGURE is a sectional view through a plane perpendicular to the axes.

To carry out the electrophotographic reproduction process, with reversed development, on a conducting support using a single-component magnetic development powder, which is the subject of the invention, the device which is also the subject of the invention, and is shown in the attached FIGURE, can be used.

The device according to the invention incorporates, in particular:

a photoconducting surface (1) consisting of a cylindrical surface of selenium, magnetic means (2), consisting of a magnetic brush, intended for directing a single-component magnetic development powder (3) into proximity with the photoconducting surface (1) and for developing in a reversed manner a charge image formed on the photoconducting surface, to obtain a powder image, means for transferring at (4) the powder image onto a conducting support (5) consisting of a metal cylinder, means (6) for wetting the conducting support (5) with a volatile dielectric liquid (7) of volume resistivity greater than $10^3 \Omega cm^2/cm$, prior to transferring the powder image, means for transferring at (26) the powder image from the conducting support (5) onto a copy support (9), means for fixing the powder image on the copy support (9), means (10,11,12) for connecting, respectively, the photoconducting surface (1), magnetic means (2) and conducting support (5) to the terminal of one and the same voltage generator (13), the terminal having the same sign as that of the charge on the photoconducting surface (1), that is to say, in the present case, to the positive terminal since the photoconducting surface (1) is of selenium.

The magnetic brush (2) is composed of a sleeve (22) in which magnets rotate, one part of its external surface, that is to say of its sleeve (22), is in contact with the magnetic development powder (3), the latter being present in a container (18).

The means for transferring at (4) the powder image from the photoconducting surface (1) onto the conducting support (5) employ, according to the present embodiment, the action of an electric field combined with the action of the pressure between the photoconducting surface (1) and the conducting support (5).

The means (6) for wetting the conducting support (5) with a volatile dielectric liquid (7) of volume resistivity greater than $10^3\Omega cm^2/cm$, prior to transferring the powder image, consist, according to the present embodiment, of a coating roller (19) wetted by contact with a porous block (20) partly submerged in the dielectric liquid (7) present in a reservoir (21).

The means for transferring the powder image from the conducting support (5) to the copy support (9) employ, according to the embodiment of the invention shown in the FIGURE, the pressure existing between the conducting support (5) and the roller (8). The copy support (9) moves forward as a result of the rotation of the conducting support (5) and the roller (8) in an opposite direction to each other, and the pressure existing between the conducting support (5) and the roller (8) simultaneously fixes the powder image on the copy support (9).

The means for connecting, respectively, the selenium photoconducting surface (1), the sleeve (22) of the magnetic brush (2) and the conducting support (5) to the positive terminal (23) of the voltage generator (13) consist, for example, of conducting wires (10,11,12).

In order that the voltage applied to the sleeve (22) of the magnetic brush (2) shall be at least equal to, and preferably higher than, the voltage applied to the photoconducting surface (1), a resistor element $R_1$ is located in the conducting wire (10) between the photoconducting surface (1) and the positive terminal (23) of the voltage generator (13).

In order that an electric field shall exist between the photoconducting surface (1) and the conducting support (5), a resistor element $R_2$ is located in the conducting wire (12) between the conducting support (5) and the photoconducting surface (1), the conducting support (5) being, according to the embodiment shown, connected to the positive terminal (23) of the voltage generator (13) in series with the photoconducting surface (1).

The device which is the subject of the invention naturally incorporates customary components, already described in the French Patent Application registered under No. 80/10,611, published under No. 2,482,323. These components are, in particular:

means, such as a corona effect device (14), for depositing a uniform charge on the photoconducting surface (1), means, such as an illumination device (15), for discharging the photoconducting surface (1) after transferring the powder image onto the conducting support (5), means, such as a magnetic brush (16), for cleaning the photoconducting surface (1) and eliminating from the latter all traces of development powder, a container (17) enabling the development powder to be collected. The magnetic brush (16) is connected to the positive terminal (23) of the voltage generator (13), by means of a conducting wire (27), means of drying (24), such as a fan blowing hot air, the powder image after transfer onto the conducting support (5), and these means of drying (24) permit the removal of all traces of dielectric liquid which may still be present on the conducting support (5).

There will be described below the electrophotographic reproduction process, with reversed development, on a conducting support using a single-component magnetic development powder, which is the subject of the invention, employing the device, which is also the subject of the invention, according to the embodiment shown in the attached FIGURE. The directions of rotation are indicated by arrows.

A charge image is formed on the photoconducting surface (1) from an original by means of a suitable optical system (25).

The single-component magnetic development powder (3) present in the container (18) is directed into proximity with the photoconducting surface (1) by means of the magnetic brush (2), of which part of the external surface of the sleeve (22) is in contact with the magnetic powder (3), and the charge image is developed in a reversed manner to obtain a powder image.

At (4), the powder image is transferred from the photoconducting surface (1) to the conducting support (5) through the influence of the electric field existing between the photoconducting surface (1) and the conducting support (5), in the presence of a layer of volatile dielectric liquid of volume resistivity greater than $10^3\Omega cm^2/cm$. The conducting support (5) has been coated with dielectric liquid by contact with the coating roller (19) of the means (6) for wetting the conducting support (5).

When all traces of dielectric liquid in the powder image transferred onto the conducting support (5) have been removed by blowing hot air by means of the fan (24), the powder image is transferred at (26), by means of pressure, from the conducting support (5) to the copy support (9).

Since a pressure exists between the conducting support (5) and the roller (8), the powder image is transferred and simultaneously fixed on the copy support.

Observation of the image obtained on the copy support confirms that the copy is of high quality. In fact, it shows no difference in density, the dark regions being uniform.

The image obtained is well defined and shows no background staining.

The process which is the subject of the invention and the device for carrying it out have numerous advantages.

In effect, the process and the device for carrying it out, according to the invention, with reversed development on a conducting support using a single-component magnetic development powder, enable an image of very high quality to be obtained. The image obtained does not show lighter regions in the dark regions, is well defined and in addition is formed on a clean background.

Since, the electrophotographic reproduction process with reversed development on a conducting support using a single-component magnetic development powder, which is the subject of the invention, does not impose a change in polarity of the charge on the photoconducting surface nor a change in the single-component magnetic development powder with respect to the electrophotographic reproduction process with direct development, it is also possible to obtain with the device according to the invention, a powder image identical with the original, which means that the charge image is developed in a direct manner, by providing electric means adapted to act only during the charge image development in order to allow a direct development.

It is naturally not a departure from the scope of the invention to produce a device for electrophotographic reproduction on a conducting support using a single-component magnetic development powder according to the French Patent Application registered under No. 80/10,611, published under No. 2,482,323, which incorporates means such as a switch, making it possible with the device to carry out the electrophotographic reproduction process with reversed development on a conducting support using a single-component magnetic development powder, which process is the subject of the present invention.

The advantages of the process according to the invention are well demonstrated by the examples below:

EXAMPLES

On a selenium photoconducting surface (1), positive charges are uniformly deposited by means of a corona effect device (14) formed by two wires spaced 11 mm apart and located at 11 mm from the photoconducting surface (1). The corona effect device is supplied with a continuous voltage of 6,500 volts. The residual surface voltage of the charged photoconducting surface after 10 seconds is 1,300 volts (voltage measured with a MONROE model 244 electrometer).

The photoconducting surface (1) is exposed using an original consisting of a REGMA screen, by means of a suitable optical system (25). The luminous radiation is delivered by a SYLVANIA 600 watt bulb, which delivers 400 Lux at the photoconducting surface (1). The enlargement ratio used is 1.

The charge image obtained is developed, in a reversed manner, using a negative single-component development powder for pressure fixing, sold under the trade name HMT 824-3 by the company HITACHI METALS LTD.

A magnetic brush (2) was used having a fixed sleeve (22) with magnets rotating at a speed of 600 rpm so as to cause movement of the development powder. The distance between the sleeve (22) without development powder and the photoconducting surface (1) is approximately 0.3 mm and the thickness of development powder carried by the magnetic brush (2) is approximately 0.2 mm.

The conducting support (5) consists of a metal cylinder of polished appearance, which has previously been coated with a layer of dielectric liquid consisting of an isoparaffin hydrocarbon sold under the trade name ISOPAR G by the ESSO company.

The image is transferred by pressure, under a pressure of 25 kg/cm between the conducting support (5) and the roller (8), onto a copy support (9) consisting of a sheet of ordinary paper sold under the trade name VELIN 75 RG by the paper manufacturers VOIRON DES GORGES.

1st Example

The sleeve (22) of the magnetic brush (2) is polarised by means of a positive voltage of 1,500 volts, the photoconducting surface (1) is subjected to a positive voltage of 700 volts and the conducting support (5) is grounded. However the image obtained on the copy support (9) is not of satisfactory quality.

2nd Example

A voltage generator (13) delivering a voltage of approximately 1,600 volts is used.

The photoconducting surface (1) is connected by the conducting wire (10) to the positive terminal (23) of the voltage generator (13) by way of a 20 MΩresistor element $R_1$. The voltage applied to the photoconducting surface (1) is approximately 650 volts.

The sleeve (22) of the magnetic brush (2) is connected directly by the conducting wire (11) to the positive terminal (23) of the voltage generator (13). The sleeve (22) of the magnetic brush (2) is then brought to a voltage which is approximately 1,000 volts greater than the voltage to which the photoconducting surface is brought.

The conducting support is connected to the positive terminal (23) of the voltage generator (13) by the conducting wire (12) by way of the 10 MΩ resistor element $R_2$ which is in series with the photoconducting surface (1) and the resistor element $R_1$.

Now, the image obtained on the copy support (9) is observed to be of very high quality.

I claim:

1. In a reversed development electrophotographic reproduction process in which an electrostatic latent image on a photoconductor surface is developed by magnetic means, with a single component magnetic development powder, to form a reversed powder image corresponding to the latent image, and the powder image is transferred onto a conductive support wetted with a volatile dielectric liquid of volume resistivity greater than $10^3\Omega cm^2/cm$, the improvement which comprises connecting each of the photoconductor surface, the magnetic means and the conducting support to the terminal of at least one voltage generator, the terminal having the same polarity as that of the charge on the photoconductor surface.

2. The process of claim 1 in which only a single voltage generator is used.

3. The process of claim 1 or claim 12 which comprises applying a voltage to the magnetic means which is at least of the same magnitude as the voltage applied to the photoconductor surface.

4. The process of claim 3 which comprises applying a voltage to the magnetic means of greater magnitude than the voltage applied to the photoconductor surface.

5. The process of claim 1 in which the powder image is fixed onto the conducting support.

6. The process of claim 1 in which the powder image is transferred from the conducting support onto a copy support and is fixed onto the copy support.

7. In apparatus for the reverse development of an electrostatic image including a photoconducting surface, a magnetic means for directing a single-component magnetic development powder into proximity with a charge image on the photoconducting surface and developing, in a reversed manner, the charge image to obtain a powder image, means for transferring the powder image onto a conducting support, and means for wetting the conducting support with a volatile dielectric liquid of volume resistivity greater than $10^3\Omega cm^2/cm$, prior to transferring the powder image, the improvement which comprises means for connecting the photoconducting surface, the magnetic means and the conducting support to the terminal of at least one voltage generator, the terminal having the same sign as that of the charge on the photoconducting surface.

8. Apparatus according to claim 7 wherein the photoconducting surface, the magnetic means and the conducting support are connected to the terminal having the same sign as that of the charge on the photoconducting surface of a single voltage generator.

9. Apparatus according to either one of claim 7 or 8 which further comprises means for applying to the magnetic means a voltage which is at least equal to the voltage applied to the photoconducting surface.

10. Apparatus according to claim 9 which further comprises means for applying to the magnetic means a voltage which is higher than the voltage applied to the photoconducting surface.

11. Apparatus according to any one of claims 7 or 8 in which the magnetic means comprises a magnetic brush, including a sleeve, wherein the sleeve of the magnetic brush is connected to the voltage generator via said, terminal.

12. Apparatus according to claim 9 in which the magnetic means comprises a magnetic brush, including a sleeve, wherein the sleeve of the magnetic brush is connected to the voltage generator via said terminal.

13. Apparatus according to claim 10 in which the magnetic means comprises a magnetic brush, including a sleeve, wherein the sleeve of the magnetic brush is connected to the voltage generator via said terminal.

14. Apparatus according to claim 7 which further comprises means for fixing the powder image onto the conducting support.

15. Apparatus according to claim 7 which further comprises means for transferring the powder image from the conducting support onto a copy support and means for fixing the powder image onto the copy support.

* * * * *

UNITED STATES PATENT AND TRADEMARK OFFICE

CERTIFICATE OF CORRECTION

PATENT NO. : 4,607,940

DATED : August 26, 1986

INVENTOR(S) : PHAM KIM QUANG

It is certified that error appears in the above-identified patent and that said Letters Patent is hereby corrected as shown below:

ON THE TITLE PAGE

[54] In the title,
delete "PRODUCTION",
insert --REPRODUCTION--.

IN THE CLAIMS

Claim 3, line 1, (column 10, line 28),
delete "12", insert --2--.

Signed and Sealed this

Thirteenth Day of January, 1987

*Attest:*

DONALD J. QUIGG

*Attesting Officer*

*Commissioner of Patents and Trademarks*